US008141482B2

(12) United States Patent
Schaltegger et al.

(10) Patent No.: US 8,141,482 B2
(45) Date of Patent: Mar. 27, 2012

(54) HYDRAULIC FINE BLANKING HEAD FOR A PRESS AND METHOD OF ITS INFEED

(75) Inventors: Markus Schaltegger, Berne (CH); Alfio Cristofaro, Reichenburg (CH); Juerg Ochsenbein, Berne (CH)

(73) Assignee: Feintool Intellectual Property AG, Niederwanden Bei Bern (CH)

( * ) Notice: Subject to any disclaimer, the term of this patent is extended or adjusted under 35 U.S.C. 154(b) by 0 days.

(21) Appl. No.: 12/792,977

(22) Filed: Jun. 3, 2010

(65) Prior Publication Data

US 2011/0000349 A1 Jan. 6, 2011

(30) Foreign Application Priority Data

Jun. 3, 2009 (EP) ..... 09007352

(51) Int. Cl.
*B30B 15/10* (2006.01)
*B26D 7/26* (2006.01)

(52) U.S. Cl. ..... 100/257; 100/35; 100/347; 100/219; 100/269.19; 83/526; 83/527

(58) Field of Classification Search ..... 100/35, 100/43, 48, 347, 257, 269.14, 269.19, 282, 100/289, 219; 72/21.5, 446, 448; 83/55, 83/525, 526, 527, 530; 74/583, 586
See application file for complete search history.

(56) References Cited

U.S. PATENT DOCUMENTS

| | | | | |
|---|---|---|---|---|
| 4,150,618 | A * | 4/1979 | Spanke et al. | 100/257 |
| 5,349,902 | A * | 9/1994 | Daniel et al. | 100/48 |
| 5,791,240 | A | 8/1998 | Yagi et al. | |
| 6,267,050 | B1 * | 7/2001 | Brewer | 100/257 |
| 6,715,409 | B2 * | 4/2004 | Brewer et al. | 100/35 |

FOREIGN PATENT DOCUMENTS

| | | |
|---|---|---|
| DE | 1 279 622 | 10/1968 |
| DE | 2 039 644 | 3/1972 |
| DE | 198 22 436 | 10/1999 |
| GB | 1 419 324 | 12/1975 |
| WO | WO 0138019 A1 * | 5/2001 |

* cited by examiner

*Primary Examiner* — Jimmy T Nguyen
(74) *Attorney, Agent, or Firm* — Jordan and Hamburg LLP

(57) ABSTRACT

A hydraulic fine blanking head for a mechanical press and an infeeding method for same. The hydraulic fine blanking head includes an adjusting mechanism having an adjusting nut provided with an internal motion thread engaged with external motion threads on a main cylinder, the adjusting nut being turnable around a stroke axis, a sprocket wheel rotatable at a frontal surface of the adjusting nut, a hydraulic motor driving the sprocket wheel, and a brake for the motor shaft. Axial backlash between the respective motion threads is prohibited by a pressure generated by a flow of pressurized hydraulic fluid which also generates a part forming force in the head. A conduit in communication with a hydraulic system and the interior of the head delivers the locking pressure, locking the threads against the backlash. Removal of pressure unlocks the threads. Infeed of the main cylinder with regard to the ram is adjustable by switching the motor and the brake on and off.

17 Claims, 8 Drawing Sheets

HYDRAULIC FINE BLANKING HEAD FOR A PRESS AND METHOD OF ITS INFEED

BACKGROUND OF THE INVENTION

The invention relates to a hydraulic fine blanking head for a mechanical press, specifically a fine blanking press, which is supported by a head piece mounted on a press machine frame above a ram, which ram supports a table top and executes a stroke movement in axial alignment to its stroke axis, with a flange inserted into the head piece with a tube-like design, the shoulder of which fine blanking head is fixed by screwed connections at the side of the head piece facing the ram. The head piece includes a tube-like main cylinder with pistons and pins positioned inside thereof, with, the main cylinder being pressure tight and closed with a cover or a retaining plate, and a hydraulic system for feeding the main cylinder with a pressure fluid adjusted to a desired pressure.

The invention further relates to a method for infeeding a high pressure hydraulic fluid to a hydraulic fine blanking head in a press, specifically a fine blanking press, wherein an adjustable pressure is applied through a hydraulic fluid fed to the fine blanking head from a high pressure source to pistons retained in the main cylinder, which produces a pressure and/or deformation force, which actuates the press ram mechanically or hydraulically.

DE 1 279 622 A1 discloses a fine blanking press with a cutting piston, a plunger piston pressing a sheet metal workpiece onto the bedplate of the press and a pressure piston supporting the part of the workpiece that is to be cut out, wherein the head of the press is provided with an adjusting spindle for adjusting a stopping flange that limits the stroke of the movable yoke at the upper side. The limiting/stopping of the movable yoke is adjusted by turning threaded cylinders running one in another. The fine adjustment of the thread is carried out by means of a handwheel via a worm to a toothed wheel directly attached to the bottom of the outer threaded cylinder, whereas a quicker, less fine adjustment is provided by an electrical motor driving the worm via two bevel gears.

Height adjustment of the cutting head due to the manual operation as described above does not permit a sufficient adjusting and infeed accuracy regarding the height position of the head. In addition it is of disadvantage that the repeating accuracy of the adjustment is low, such that the quality of the fine blanked parts suffers.

A further disadvantage is that a spindle distortion due to the normally existing axial backlash between the cylinders can not be excluded.

Other known solutions for adjusting the distance between a press upper tool fixed to a ram, working together with a press lower tool fixed to a bedplate, and the ram use arrangements of pressure wedges (DE 2 039 644 A1) or hydraulically actuated cylinders (DE 198 22 436 A1). However, these known solutions due to the cooperation of cutting piston, V-shaped projection piston and V-shaped projection pins are not suitable for fine blanking presses.

SUMMARY OF THE INVENTION

The present invention provides a hydraulic fine blanking head for presses and a method for feeding a fine blanking head of the above mentioned kind, or one that securely avoids the axial backlash between the adjustment elements during the fine blanking operations, to provide a high infeed, repeating accuracy, and simultaneous increase in operational reliability under conditions of continuous operation.

With the present invention, the infeeding of the fine blanking head is integrated with existing functional elements of the head, providing an adjusting mechanism including an adjusting nut having an internal motion thread that is turnable around the stroke axis of the ram, a sprocket wheel fixed, but free to rotate, at a front surface of the adjusting nut and vertically arranged to the stroke axis, a hydraulic motor with motor shaft provided at the headpiece, a driving chain running around the motor shaft and the sprocket wheel, and a brake positioned to brake the motor shaft and an external motion thread provided at the head of the main cylinder. The external motion thread of the main cylinder is guided with axial backlash by the internal motion thread of the adjusting nut, wherein the motion threads are connected via a common conduit for feeding and draining fluid of the hydraulic system that alternates between supplying and draining hydraulic fluid to and from the head piece to thereby generate a locking pressure and subsequent relief of same, which prevents and then allows for axial backlash between the threads of the adjustment nut and main cylinder. The infeed of the main cylinder with regard to the ram is carried out by switching off the motor and switching on the brake when the pistons and pins are relieved from pressure.

The adjusting nut is axially blocked at a wall region of the head piece on a side away from the ram having a shoulder and held by the tube-like part of the flange against the lifting movement of the ram. This makes it possible to reduce the quantity of parts and the mass of the fine blanking head.

In a specific aspect of the fine blanking head according to the invention, the conduit for feeding the fluid to the motion threads is connected to a low-pressure hydraulic system by a pipe via a switchable directional control valve included in the system for opening and closing the pipe, which makes it possible to respectively lock the motion threads of the adjusting mechanism in dependence of the presence of pressure at the pistons and the pins and to unlock the motion threads when the pressure is released. Specifically, when the pressure is released, the hydraulic fluid is returned to the hydraulic motor, at a time when the backlash between the motion threads is permitted and infeed is desired by the fine blanking or forming operation. The blocking pressure acting on the adjusting mechanism for example can be adjusted by the pilot control of the directional control valve to a low pressure of for instance 65 bar.

In another aspect, the head piece and the adjusting nut are provided with at least one common conduit opening into the motion thread, in order to supply the threads with lubricant that facilitates smooth operation of the adjusting nut. The tube-like part of the flange is provided with at least one further conduit for draining the lubricant from the motion threads, so that a continuous lubrication of the motion threads through a pipe, which is connected to a lubricant reservoir, is possible.

According to a still further aspect of the invention the motion threads provided on the adjusting nut and main cylinder are configured as breech block threads tolerating a one-side static stress in the case of axial admission of hydraulic fluid under locking pressure, wherein the motion thread of the main cylinder presses against the motion thread of the adjusting nut, and the adjusting nut presses against the shoulder at the head piece. In this case backlashes, i.e., back threading is eliminated, and the adjusting mechanism is locked, when the device is pressurized with displacement or working pressure.

In another specific aspect of the fine blanking head according to the invention, the hydraulic motor is connected to a high-pressure hydraulic system having a feeding pipe and a draining pipe via a pilot operated proportional valve. The rotation speed of the motor can be controlled by adjusting a predetermined actuating pressure.

In a more specific aspect, the motor brake is connected to the high-pressure hydraulic system by a switchable directional control valve for switching the brake on and off, whereby accurate braking according to the position infeed of the fine blanking head according to the invention becomes possible.

In a further preferred aspect of the invention the driving chain is a hollow pin chain, which advantageously engages with the sprocket wheel on the adjusting nut, wherein a second sprocket wheel is also provided, having a rotation axis arranged in parallel with respect to the sprocket wheel of the adjusting nut on a plate supported by the headpiece. The sprocket wheels lie on one plane in horizontal alignment, so that a torsion-free drive of the hollow pin chain is guaranteed.

According to a further specific aspect of the fine blanking head according to the invention a touch table is provided at the retaining plate facing the ram, which is attached by safety pins inserted into holes in the tube-like part of the flange arranged parallel to the stroke axis of the ram.

In a still further aspect, particularly adapted to a fine blanking operation, the main cylinder houses a V-shaped projection piston having a V-shaped projection that is pressed against a work piece to be processed, and projection pins that coaxially support the V-shaped projection piston, and a touch piston for detecting a lifting distance provided between the retaining plate and the touch table, in which the pistons lie on the stroke axis.

According to a further aspect of the fine blanking head according to the invention, in the retaining plate is positioned a pressure plate supporting the V-shaped projection pins coaxially with regard to the stroke axis, wherein a central support is provided in alignment with the stroke axis, wherein the pressure plate is held by a retaining ring at the touch table.

In yet another aspect, the invention is a method including the following steps:

a Locking the motion threads of the adjusting nut and main cylinder in a position that prohibits axial backlash, i.e.,axial back threading, through admission of a fluid under pressure that also provides force necessary for fine blanking part formation, by feeding a pressurized hydraulic fluid to the fine blanking head through a conduit in the head, and attaining a predetermined locking pressure, b Unlocking both of the motion threads by relieving the pressure and forming force by switching off the locking pressure by shutting off the flow of hydraulic fluid in the conduit, c Feeding an actuating pressure fluid to a hydraulic motor at a predetermined pressure to operate the adjusting mechanism by turning the adjusting nut sprocket wheel via a drive chain driven by the motor until the main cylinder has reached a predetermined infeed position, d Switching off the motor by shutting of the flow of pressure fluid and connecting the brake pressure adjusted by the actuating pressure to a brake pressure fluid for fixing the adjusted position of the fine blanking head and e again switching on the locking pressure to the adjusting mechanism for locking the motion threads according to step a.

The fine blanking head according to the invention is not only usable for mechanically driven presses, but also for hydraulic presses. Due to the integration of the adjusting means into the fine blanking head it is possible to prohibit the axial backlash between the adjusting elements during cutting operations, to reach a high infeed and repeating accuracy and to simultaneously increase the operational security during continuous operation.

Further advantages and details of the invention accrue from the following description with reference to the attached drawings.

DETAILED DESCRIPTION OF THE INVENTION

Figure 1:
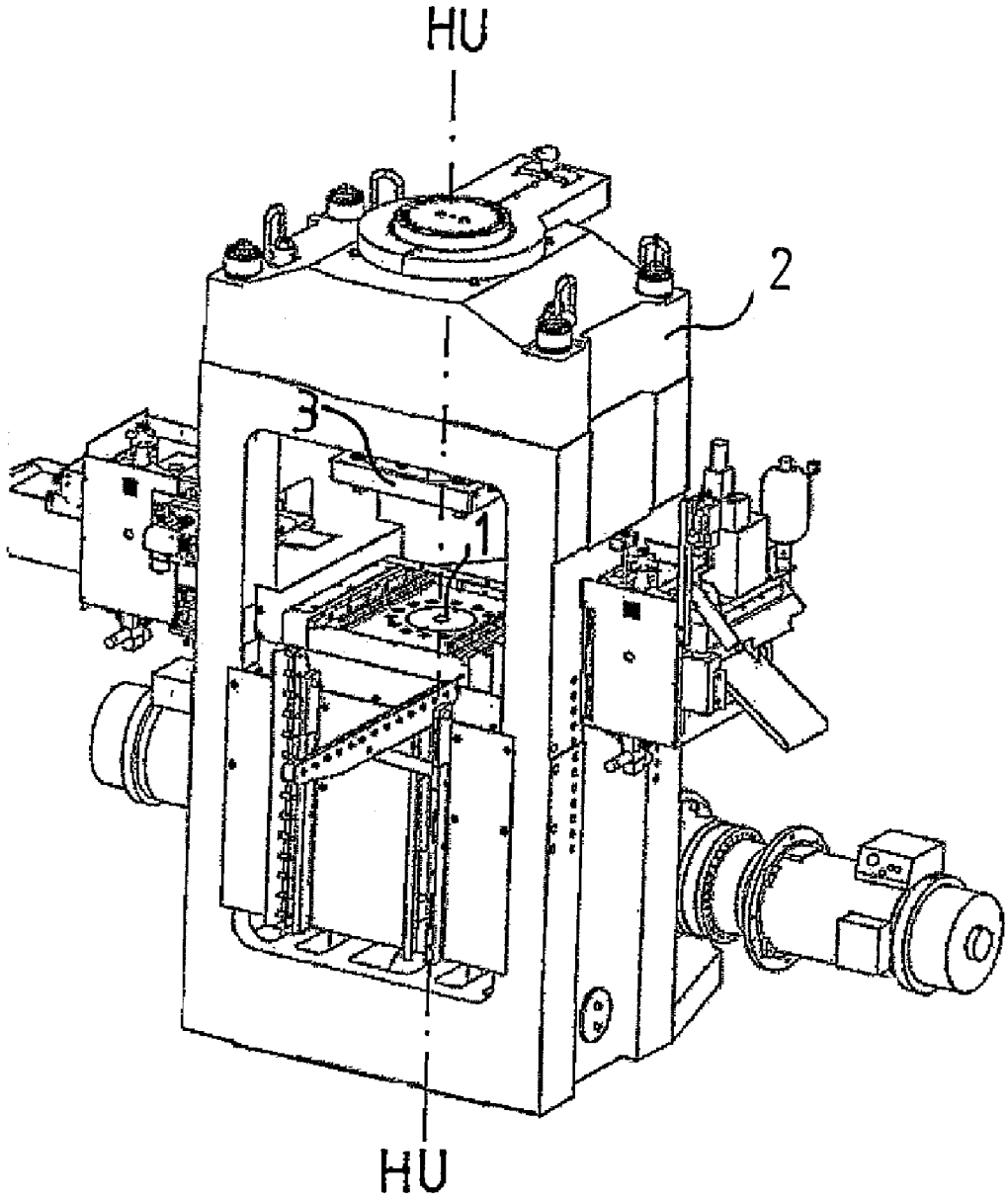
FIG. 1 is a perspective view of the press with mechanisms assembled in the head piece of the press fine blanking head according to the invention.

FIG. 1 shows a perspective view of a mechanically driven toggle-type fine blanking press. The ram 1 supports a table top and can move upward along stroke axis HU, in the direction of the head piece 2 of the press. Fine blanking head 3 is positioned in the head piece 2 of the press in alignment with the stroke axis HU.

Figure 2:
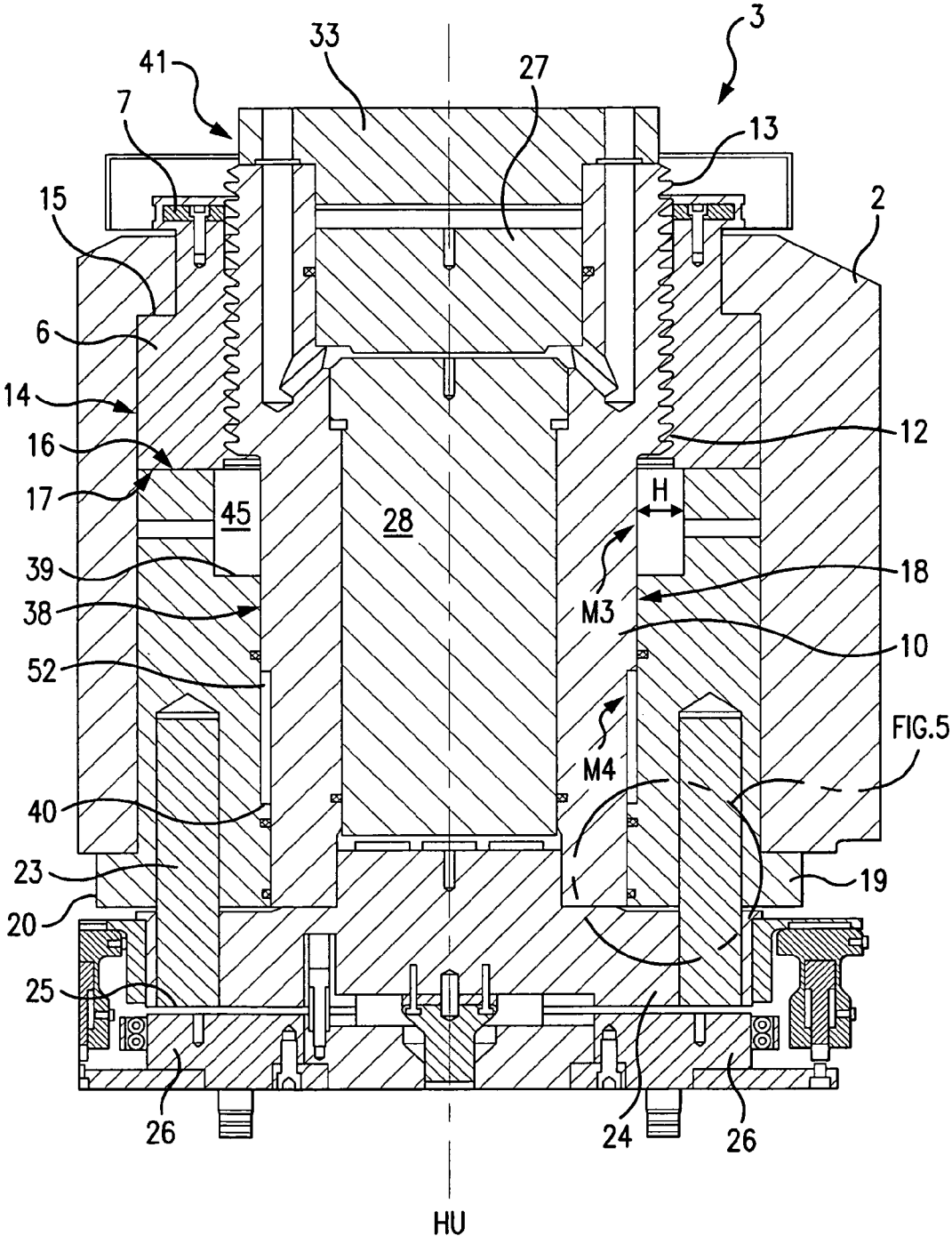
FIG. 2 is a cross-section of the fine blanking head according to the invention in the retracted position.
Figure 3:
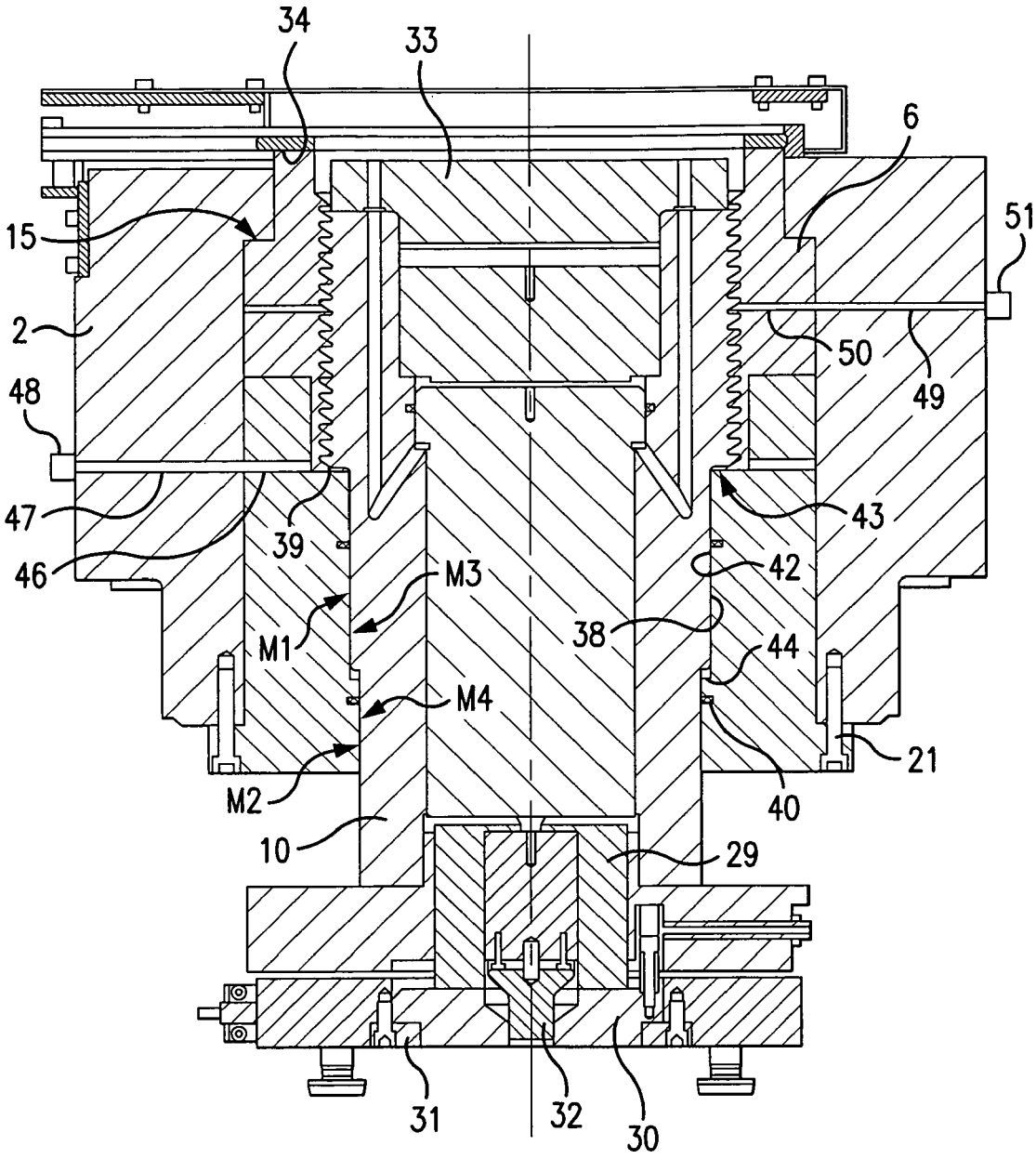
FIG. 3 is a cross-section of the fine blanking head according to the invention in the extended position.
Figure 6:
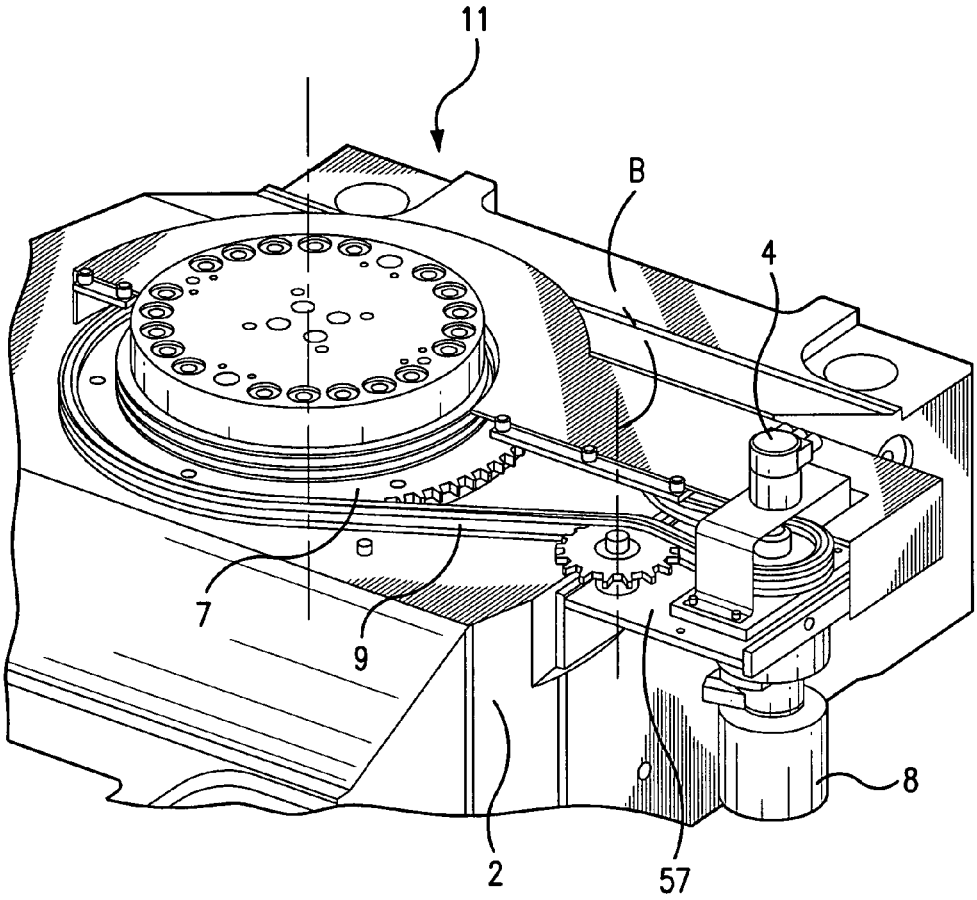
FIG. 6 is a perspective view of the adjusting mechanism with hydraulic motor and hollow pin chain.

FIG. 2 shows a cross-section of the fine blanking head 3. As exemplified in FIGS. 2 and 4, fine blanking head 3 resides in a seating provided in the head piece 2 and is fixed in a form-fit arrangement. With reference to FIG. 6 as well, it is shown that fine blanking head 3 is provided with a motor-driven adjustment mechanism 11 assembled of adjusting nut 6, sprocket wheel 7, hydraulic motor 8, rotary encoder 4, driving chain 9 and main cylinder 10. Adjusting nut 6 can rotate around the stroke axis HU. Main cylinder 10 is positioned alongside the stroke axis HU, and is interior to the adjusting nut 6. Adjusting nut 6 and main cylinder 10 are provided with interengaged motion threads 12 and 13 that are matched with regard to their flank angles, which threads 12 and 13 are breech block threads engaged coaxially with regard to the stroke axis HU, so that, when the adjusting nut 6 is turned, the main cylinder 10, with respect to the ram 1, can be transferred from a retracted position to an extended position, as shown in FIG. 3. In other words, the main cylinder 10 is adjustable to ram 1 with regard to its height.

The head piece 2 has a step-like shoulder 15 that projects towards the head interior, that is, towards the stroke axis HU. Step-like shoulder 15 is located at the side directed to the head. Below the shoulder, the head piece 2 has a radial diameter greater than the radial diameter of the step-like shoulder 15. Step-like shoulder 15 is supported axially by the adjusting nut 6. The outer contour of the adjusting nut 6 complements the contour of the step-like shoulder. A lower side 16 of the adjusting nut 6 rests on upper side 17 of a tube-like part 18 of a flange 19 that is inserted into the head piece 2, whereby the adjusting nut 6 is axially secured at its interior and exterior sides. Thus, the adjusting nut is axially supported.

As shown in FIGS. 2 and 3, shoulder 20 of the flange 19 is fixed to the head piece 2 at the side facing the ram by threaded connectors 21 extending towards the head piece 2. Shoulder 20 of flange 19 is provided with two oppositely positioned holes 22 positioned to parallel the stroke axis HU. Holes 22 extend into the tube-like part 18, and receive pin-like antitwist protections 23 that axially guide a main plate 24 that closes the main cylinder 10. The front side 25 of the antitwist protections 23 is secured by a screwed joint.

Main cylinder 10 of fine blanking head 3 accommodates a V-shaped projection piston 27 and a touch piston 28 that are in axial alignment to each other. The V-shaped projection piston 27 is in mechanical stop with the main cylinder 10. The touch piston 28 is hydraulically brought into positive locking with the V-shaped projection piston 27. The V-shaped projection pins 29, shown in FIG. 3, project through the main plate 24 and rest on a V-shaped projection pressure plate 30, which is secured by a V-shaped projection retaining ring 31 fixed to the touch table 26. Main plate 24 is held on the central support 32, which supports the tool during the technology phase.

The head of the main cylinder 10 is closed with a pressure tight seal by a V-shaped projection cover 33. As seen in FIGS. 2 and 6, on the upper frontal side 34 of the adjusting nut 6, sprocket wheel 7 can rotate, which via the driving chain 9, for example a hollow pin chain, is driven by the hydraulic motor 8, which turns the adjusting nut 6 around its axis, which is in coincidence with the stroke axis HU. The layout of this drive is further described later in this disclosure.

The tube-like part 18 of flange 19, at an inner wall 38 facing the stroke axis HU has a step-like upper shoulder 39 extending perpendicular to the stroke axis HU and a shoulder 40 positioned lower than shoulder 39 that also extends perpendicular to the stroke axis HU. Upper shoulder 39, in comparison to lower shoulder 40, has a significantly larger step height H. Shoulders 39 and 40 define axial support surfaces M1 and M2 on inner wall 38 of the tube-like part 18, which axial support surfaces M1 and M2 are offset from each other. Axial support surfaces M1 and M2 glidingly support a respectively shaped main cylinder 10.

The external motion thread 13 on the head 41 of the main cylinder 10 is provided with a length such that it extends over the whole length of the internal motion thread 12 of the adjusting nut 6. The external motion thread 13 on the head 41 of the main cylinder 10 has a lower end at an upper retracted shoulder 43, which is positioned above an external wall 42 of the main cylinder 10, with the external wall positioned radially inward of the external motion thread 13 (See FIG. 3). The external wall 42 has a lower shoulder 44 that extends more inward radially, that is, closer to the stroke axis, relative to external wall 42 and motion thread 13. Thus, shoulders 43 and 44 define height support surfaces M3 and M4 in external wall 42 that are axially offset from each other. Height support surfaces M3 and M4 glidingly support the lateral surfaces M1 and M2 provided on the inner wall 38 of the tube-like part 18.

As shown in FIG. 2, motion threads 12 and 13 of the adjusting mechanism 11 are retracted. In this state, a clearance 45 is provided below the motion threads 12 and 13, which is defined by the upper shoulder 39 of the tube-like part 18 of the flange 19, the upper retracted shoulder 43 on the head of main cylinder 10, and at internal wall 38.

A conduit 46 is provided in the wall of the tube-like part 18 and extends into clearance 45. Further, a conduit 47 is provided in the wall of the head piece 2, which is connected to conduit 46 at one end and to a pipe 48 at its other end for draining lubricant into a reservoir of a lubricating system that is not further shown. Above the conduits 46 and 47, a further conduit 49 is provided in the wall of the head piece 2 and a conduit 50 is provided in the wall of the adjusting nut 6, wherein the conduit 50 opens into the motion thread 12 of the adjusting nut 6 for feeding lubricant. The conduit 49 is connected to a pipe 51. Through a pump, lubricant can be fed to lubricate the motion threads 12 and 13.

Figure 5:
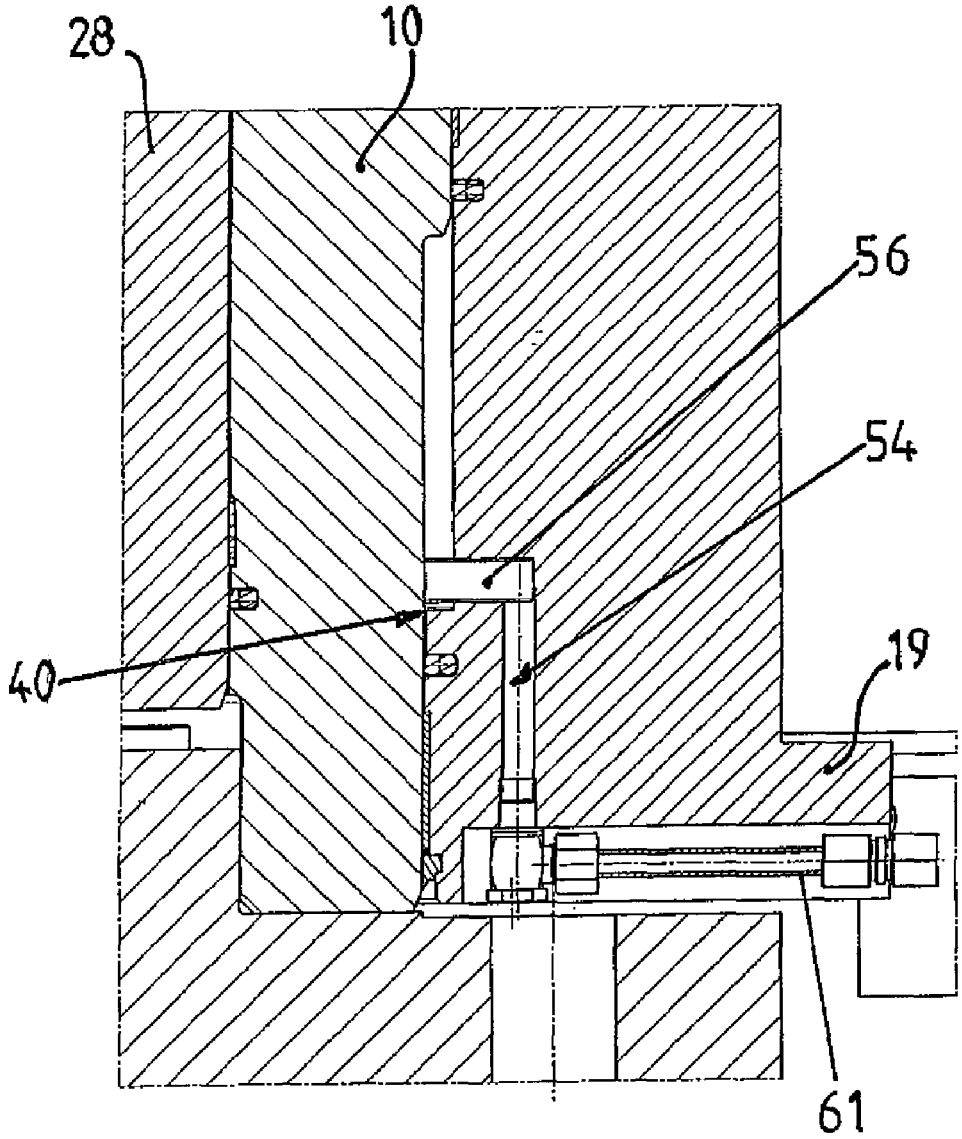
FIG. 5 is a view of the conduit for feeding hydraulic fluid to the motion threads of the adjusting mechanism as cross-section along V-V of FIG. 4.

Axial support surfaces M3 and M4 on external wall 42 of main cylinder 10 support axial support surfaces M1 and M2 on internal wall 38 of the tube-like part 18. As shown in FIG. 2, a narrow, axially extending clearance 52 is provided between the lower shoulder 44 of the external wall 42 of the main cylinder 10 and the lower shoulder 40 of the internal wall 38 of the tube-like part 18. As shown in FIG. 5, a feeding conduit 54 extends into the clearance 52, which via a feeding pipe 61 is connected to a pressure pipe 53 of a low-pressure hydraulic system. See FIG. 8. The feeding conduit 54 herein penetrates the wall of flange 19 and the wall of the tube-like part 18. The pressure pipe 53 via a directional control valve 55 (see FIG. 8) is connected to a hydraulic system, that can reduce the pressure of the hydraulic system to a value sufficient to lock the motion threads 12 and 13.

FIG. 3 shows the fine blanking head 3 according to the invention in the extended state, in which the main cylinder 10 has moved due to the rotation of the adjusting nut 6. In this position, the upper shoulder 43 of main cylinder 10 has moved to be in close proximity to the upper shoulder 39 of the tube-like part 18 of flange 19, and is held at a determined distance to the shoulder 39. The maximum infeed height of the fine blanking head 3 with regard to the ram 1 of the press is determined by means of a rotary encoder 4, positioned at the hydraulic motor 8. The main cylinder 10 then adjusts the fine blanking plate 24 together with the touch table 26 by a selected amount into the direction of the ram 1.

Figure 4:
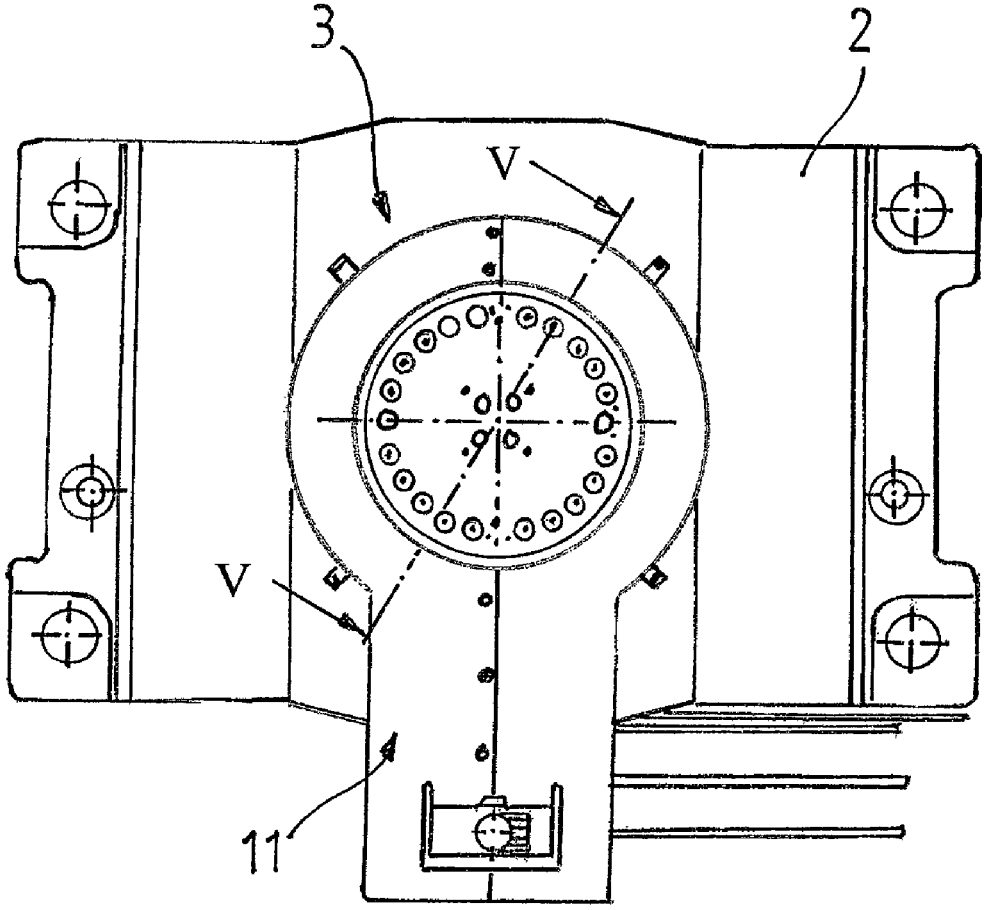
FIG. 4 is a top view of FIG. 1 of the fine blanking head according to the invention in the extended position.

FIG. 4 and FIG. 5 illustrate the position of the feeding conduit 56. Via the clearance 52, lower shoulder 40 provided on tube-like portion 18 of flange 19 and lower shoulder 44 provided on the main cylinder 10 are hydraulically moved in directions opposite each other, so that locking pressure of the hydraulic fluid can press the motion thread 13 of the main cylinder 10 against the motion thread 12 of the adjusting nut 6, through action of a directional control valve 55 responding to a predetermined preset. See FIG. 8. This action results in the locking of the motion threads.

Figure 7:
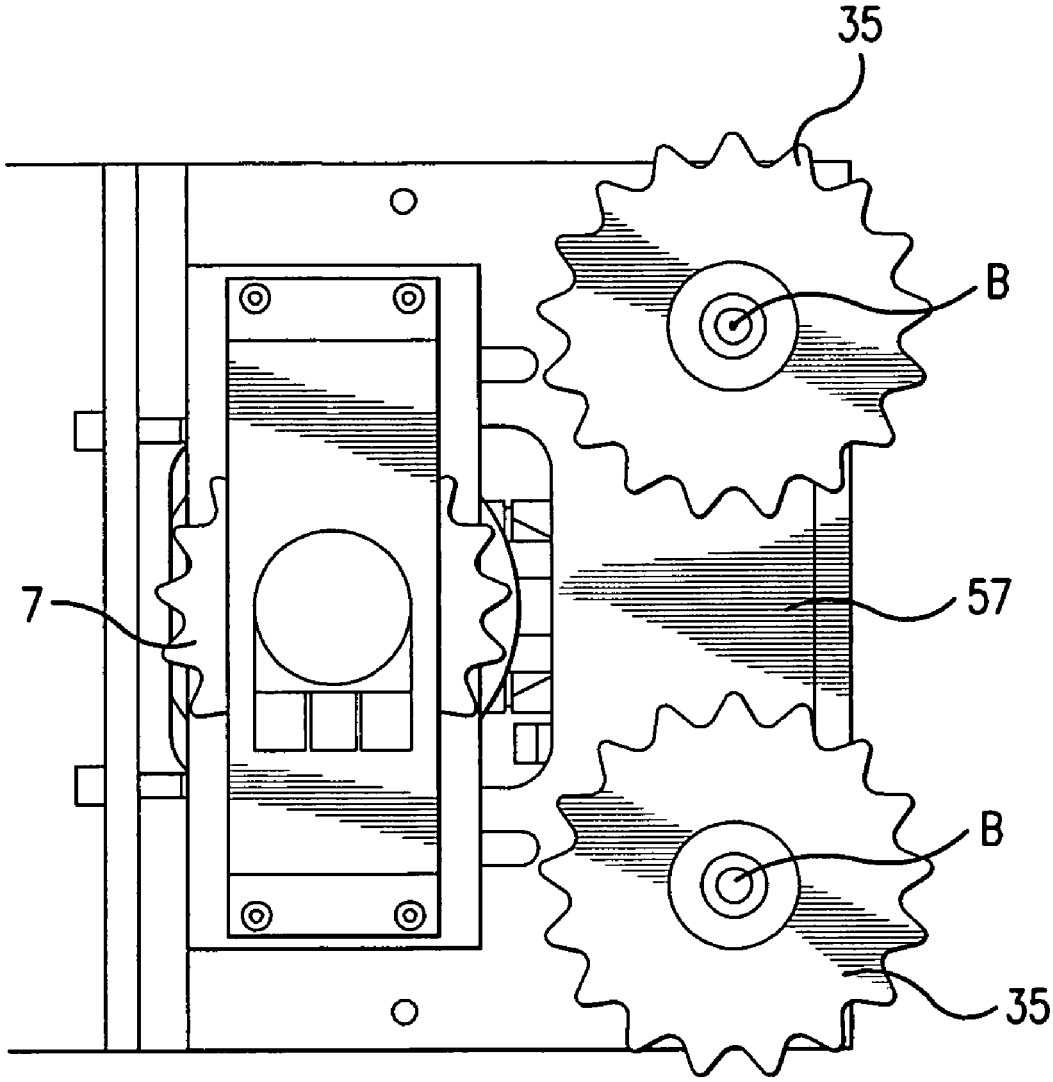
FIG. 7 is a top view of the hydraulic motor with sprocket wheels.

FIGS. 6 and 7 show the adjusting mechanism at the head of the fine blanking head which, at the head piece 2, includes: hydraulic motor 8, driving chain 9, for example a hollow pin chain, and the rotary encoder 4. On a plate 57, which is arranged in a plane on the frontal side 34 of the adjusting nut 6 (See FIG. 3), sprocket wheel 7 which is in connection with adjusting nut 6 and, two sprocket wheels 35, which are positioned side by side, are turnable around axes B, which axes are parallel to each other. The driving chain 9 free of torsion runs around the sprocket wheels 7 and 35.

Figure 8:
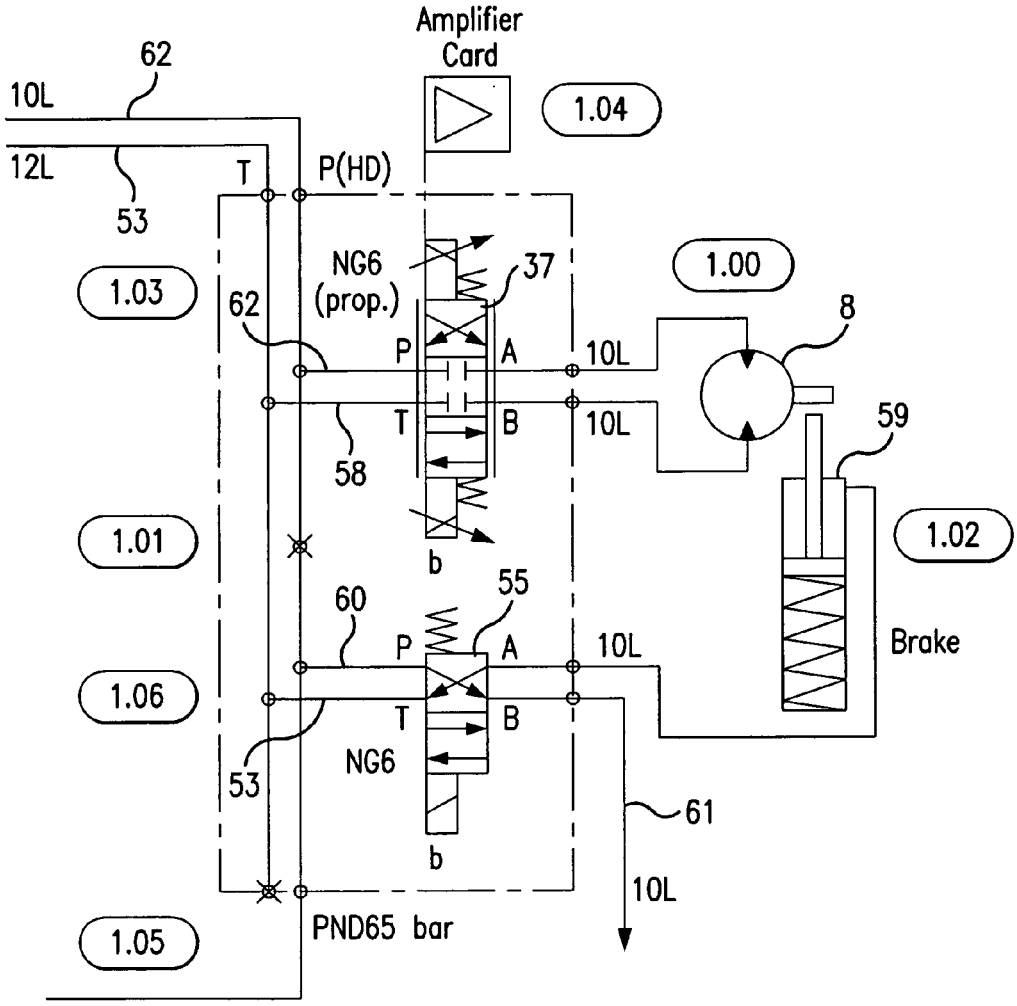
FIG. 8 is a hydraulic connection diagram of the head adjustment.

Again, with reference to FIG. 8, the hydraulic motor 8 connects to the high-pressure hydraulic system through a feeding pipe 62 and a proportional valve 37. A drain pipe 58 connects the hydraulic motor 8 via the proportional valve 37 with a reservoir pipe 53. Brake 59 is provided on the axis of the sprocket wheel 35, the brake 59 being connected to the hydraulic system by a feeding pipe 60 having a directional control valve 55.

The operation of the fine blanking head is explained in more detail with reference to FIG. 8, and other figures.

The hydraulic system includes a pressure pipe 62 fed with a pressure of 65 bar from a pressure source and the reservoir pipe 53. The pressure source is not shown in the figures.

The pressure pipe 62, via the proportional valve 37, extends to the hydraulic motor 8. The proportional valve 37 by a pilot control is adjusted to a predetermined nominal pressure, which adjusts the incoming pressure of the hydraulic fluid for the adjusting nut 6 to an actuating pressure in the range of 0 to 250 bar, preferably 220 bar. The proportional valve 37 may be a 4/3 directional control valve closed in the central position, so that the hydraulic motor 8 can be switched from the closed position to the open position, when the locked motion threads 12 and 13, which will be described in more detail below, are unlocked, and a re-adjustment of the infeed of the fine blanking head 3 with respect to the ram 1 is carried out.

When the pre-determined infeed position of the fine blanking head 3 has been reached, the proportional valve 37 switches to the closed position and brake 59 fixes the new position. This is realized by opening the directional control valve 55 that actuates the brake 59.

The hydraulic system branches off the feeding pipe 53 at pressure pipe 60, which transports the hydraulic fluid via the directional control valve 55 through conduit 61 to conduit 54 in the wall of flange 19 of the tube-like part 18 via conduit 56 and into the clearance 52, which feeds the hydraulic fluid to the adjusting mechanism 11. See FIG. 5. The directional control valve 55 lets the hydraulic fluid pass, so that a secure locking of the motion threads 12 and 13 occurs. As long as the V-shaped projection piston 27 and/or forming pressure is coming in, the motion threads stay locked. Thus, it is not possible to alter the infeed height of the fine blanking head 3 with regard to the ram.

The method according to the invention is executed as follows:

The motion thread 12 of the adjusting nut 6 and the motion thread 13 of the main cylinder 10 are hydraulically locked in the axial direction when the pressure and forming force is produced by feeding a hydraulic fluid maintained at a locking pressure. After the production of the pressure and forming force is not needed, the motion threads 12 and 13 are unlocked by shutting off the hydraulic fluid, thus removing the pressure that had maintained the motion threads in a locked arrangement. Axial backlash along motion threads 12 and 13 is now possible.

Freeing the motion threads to move frees the main cylinder to move as well. The hydraulic motor 8 starts operating, translating action through sprocket wheel 7 and driving chain 9, turning the motion thread 12 of the adjusting nut 6 until the main cylinder 10 has reached its pre-determined position with regard to ram 1, by action of the rotary encoder 4.

The hydraulic motor 8 is switched off by shutting off the hydraulic fluid. The driving shaft of the motor 8 is stopped by means of the brake 59. The locking pressure for the motion threads 12 and 13 is switched on again, so that the motion threads have no backlash on the line of force, when the V-shaped projection and/or forming pressure is effective.

The invention claimed is:

1. A hydraulic fine blanking head for a mechanical press that is supported by a head piece mounted on a machine frame of the press at a position above a ram, the ram supporting a table top, the ram executing a stroke movement on stroke axis, the hydraulic fine blanking head adapted for retention in the head piece and comprising a flange having a tube-shaped portion, the flange further having a shoulder fixed to a head piece frame on a ram-facing side of the head piece frame;

a main cylinder positioned within the tube-shaped portion of the flange;

a pair of pistons and piston pins positioned within the main cylinder;

the main cylinder having pressure tight seals provided by an upper main cylinder cover and a lower main cylinder retaining plate;

an adjusting mechanism including a cylindrical adjusting nut retained within a frame of the head piece, the cylindrical adjusting nut having an internal motion thread positioned on an interior of the cylindrical adjusting nut, the cylindrical adjusting nut being turnable around the stroke axis, a first sprocket wheel positioned on the stroke axis and being fixed to rotate at a frontal surface of the adjusting nut;

a hydraulic motor provided with a motor shaft that is located at the head piece, a driving chain in connection with the motor shaft and the first sprocket wheel;

a brake, positioned at a motor shaft braking position;

an external motion thread provided on the exterior of a head portion of the main cylinder, the external motion thread of the head portion of the main cylinder being engaged with the internal motion thread positioned on the interior of the cylindrical adjusting nut;

a conduit extending into the head piece and connected at an exterior end with a source of pressurized hydraulic fluid, the conduit delivering a flow of pressurized hydraulic fluid to a head piece position;

whereby, when the flow of the pressurized hydraulic fluid attains a locking pressure in the head piece, the external motion thread of the head portion of the main cylinder and the internal motion thread positioned on the interior of the cylindrical adjusting nut enter a locked thread position that prohibits an axial backlash of the main cylinder, and when the flow of the pressurized hydraulic fluid is shut off, the external motion thread of the head portion of the main cylinder and the internal motion thread positioned on the interior of the cylindrical adjusting nut disengage from the locked thread position and enter into an unlocked position freeing the main cylinder to move through axial backlash;

and wherein, infeed of the main cylinder with regard to the ram is adjustable by operation of the motor and the brake between on and off positions.

2. The fine blanking head according to claim 1, wherein the cylindrical adjusting nut is constrained against axial movement within the head piece frame at a head piece side distal to the ram by an inward extending shoulder positioned on the head piece frame and at a lower location within the head piece frame by an abutment between a lower surface of the cylindrical adjusting nut and the tube-shaped portion of the flange.

3. The fine blanking head according to claim 1, wherein the cylindrical adjusting nut and the head piece frame are provided with a common conduit that extends to the external motion thread of the head portion of the main cylinder and the internal motion thread positioned on the interior of the cylindrical adjusting nut, wherein the conduit supplies a lubricant to the external motion thread of the head portion of the main cylinder and the internal motion thread positioned on the interior of the cylindrical adjusting nut.

4. The fine blanking head according to claim 3, wherein the tube-shaped portion of the flange and the head piece frame are provided with a common conduit for draining a lubricant supplied to the external motion thread of the head portion of the main cylinder and the internal motion thread positioned on the interior of the cylindrical adjusting nut.

5. The fine blanking head according to one of claims 3 and 4, wherein common conduit for draining a lubricant is in fluid connection to a lubricant reservoir through a pipe.

6. The fine blanking head according to claim 1, wherein the external motion thread of the head portion of the main cylinder and the internal motion thread positioned on the interior of the cylindrical adjusting nut are breech block threads.

7. The fine blanking head according to claim 1, wherein the hydraulic motor is provided with a feeding pipe in fluid connection with a high-pressure hydraulic system through a pilot controlled proportion valve that adjusts pressure of the pressurized hydraulic fluid according to a predetermined actuating pressure.

8. The fine blanking head according to claim 1, wherein the brake is in fluid communication with a low-pressure hydraulic system through a pipe, the low-pressure hydraulic system being provided with a switchable directional control valve, whereby switching of the switchable directional control valve switches the brake between on and off positions.

9. The fine blanking head according to claim 1, wherein the conduit extending into the head piece and connected at an exterior end with a source of pressurized hydraulic fluid is in fluid communication with the low-pressure hydraulic system through a switchable directional control valve, the switchable directional control valve being switchable between an open pipe position and a closed pipe position.

10. The fine blanking head according to claim 1, wherein the driving chain is a hollow pin chain.

11. The fine blanking head according to claim 1, wherein the adjustment mechanism includes a second sprocket wheel having a rotation axis offset from the rotation axis of the first sprocket wheel, the second sprocket wheel being mounted to a plate, the first and second sprocket wheels being aligned with each other along a common horizontal plane.

12. The fine blanking head according to claim 1, wherein the lower main cylinder retaining plate is fixed in place adjacent a touch table by antitwist protection pins that connect the lower main cylinder retaining plate to the tube-shaped portion of the flange through holes provided in the tube-shaped portion of the flange that receive the antitwist protection pins.

13. The fine blanking head according to one of claims 1 and 12, wherein a V-shaped projection piston for moving a V-shaped projection, two or more V-shaped projection pins and a touch piston are positioned within the main cylinder in alignment along the stroke axis, the projection pins detecting a predetermined lifting distance between retaining plate and a touch table.

14. The fine blanking head according to claim 13, wherein the V-shaped projection pins project through the lower main cylinder retaining plate coaxial to the stroke axis, the V-shaped projection pins supporting a pressure plate; a central support for the pressure plate being provided in alignment with the stroke axis, the pressure plate is being held by a retaining ring positioned at the touch table.

15. A method for infeeding a hydraulic fine blanking head of a mechanical press, wherein a pressure derived from a pressurized hydraulic fluid adjustably displaces pistons and pins positioned in a main cylinder of the fine blanking head, in which mechanical press a press ram is actuated mechanically or hydraulically, the method comprising:

(a) locking an adjusting mechanism that includes interengaged motion threads of an adjusting nut and a main cylinder by turning the adjusting nut around a stroke axis during the generation of pressure and forming force in an interior space of the fine blanking head by delivering a flow of pressurized hydraulic fluid at a predetermined locking pressure to the interior space through a conduit in communication with the adjusting mechanism, whereby the pressure prohibits an axial backlash between the interengaged motion threads;

(b) unlocking the interengaged motion threads by shutting off the flow of pressurized hydraulic fluid in the conduit, whereby the predetermined locking pressure dissipates, (c) delivering to a hydraulic motor a flow of an actuating pressure fluid at a predetermined actuating pressure to operate the adjusting mechanism by turning a sprocket wheel that is fixed to the adjusting nut through motor-driven movement of a chain that is connected to the motor and sprocket wheel, the turning occurring until a time when the main cylinder has reached a predetermined position with regard to a preset infeed position, (d) shutting off the flow of the actuating pressure fluid to turn off the motor and adjusting a brake by connecting the brake to a flow of actuating pressure, whereby an adjusted position of the fine blanking head is provided, and (e) delivering a flow of pressurized hydraulic fluid at a predetermined locking pressure to the interior space to lock the adjusting mechanism, as set forth in step (a).

16. The fine blanking head according to claim 1, wherein the mechanical press is a fine blanking press.

17. The method according to claim 15, wherein the mechanical press is a fine blanking press.

* * * * *